US005595481A

United States Patent [19]

Miyahara

[11] Patent Number: 5,595,481

[45] Date of Patent: Jan. 21, 1997

[54] TEMPERATURE CONTROL METHOD FOR HEATING KILN

[75] Inventor: Kazuhiro Miyahara, Nagoya, Japan

[73] Assignee: NGK Insulators, Ltd., Japan

[21] Appl. No.: 443,560

[22] Filed: May 18, 1995

Related U.S. Application Data

[63] Continuation of Ser. No. 384,693, Feb. 6, 1995, abandoned, which is a continuation of Ser. No. 202,074, Feb. 25, 1994, abandoned.

[30] Foreign Application Priority Data

Mar. 30, 1993 [JP] Japan ..... 5-071832

[51] Int. Cl.[6] ..... F27D 7/00

[52] U.S. Cl. ..... 432/24; 432/137; 432/146

[58] Field of Search ..... 432/241, 128, 432/136, 137, 11.18, 19.48, 25, 145, 144, 24, 146

[56] References Cited

U.S. PATENT DOCUMENTS

| | | | |
|---|---|---|---|
| 3,795,478 | 3/1974 | Knaak | 432/146 |
| 3,887,326 | 6/1975 | Townley | 432/25 |
| 3,969,069 | 7/1976 | Knaak | 432/145 |
| 4,005,981 | 2/1977 | Turnbull | 432/137 |
| 4,128,394 | 12/1978 | Naito et al. | 432/145 |
| 4,255,133 | 3/1981 | Tanifuji et al. | 432/24 |
| 4,257,767 | 3/1981 | Price | 432/24 |

FOREIGN PATENT DOCUMENTS

| | | | |
|---|---|---|---|
| 3332989 | 10/1992 | Germany . | |
| 1111011 | 8/1984 | U.S.S.R. | 432/24 |
| 1471055 | 4/1989 | U.S.S.R. | 432/24 |
| 2146464 | 4/1985 | United Kingdom . | |

OTHER PUBLICATIONS

ABC Technik und Naturwissenschaft, Verlag Harri Deutsch, Frankfurt, Main und Zurich, (no date found).

Elektrowarme internatioal 50 B2, Aug., 1992 pp. B 184 to B 188, Aug. 1992, "Chargenangepasste Steuerung von Widerstandsöfen".

*Primary Examiner*—Willis R. Wolfe

[57] ABSTRACT

A method for controlling temperature in a heating kiln is able to maintain the temperature uniformly at a set temperature of the kiln. Output of each burner provided in the kiln is controlled on the basis of temperatures at plural positions affected by plural burners to make the temperature in the kiln substantially equal to a set temperature of the kiln. Mean values of temperatures at the plural positions are calculated and the burners are controlled to bring the mean values into coincidence with the set temperature. Alternatively, contribution rates $\alpha 1$ and $\alpha 2$ are determined which correspond to the influence of one burner on the temperature of the thermocouple for the other burner. Handicap temperatures TH1 and TH2 are then calculated by substituting temperatures T1 and T2 of the one and the other burners in equations $TH1=T1+(T2-T1)\,\alpha 1$ and $TH2=T2+(T1-T2)\,\alpha 2$. The burners are then controlled to make the handicap temperatures coincide with the set temperature.

5 Claims, 3 Drawing Sheets

TEMPERATURE CONTROL METHOD FOR HEATING KILN

This is a continuation of application Ser. No. 08/384,693 filed Feb. 6, 1995, now abandoned which in turn is a continuation of application Ser. No. 08/202,074 filed Feb. 25, 1994, now abandoned.

BACKGROUND OF THE INVENTION

The present invention relates to a temperature control method for a heating kiln, such as a tunnel kiln, shuttle kiln and the like, for heating products to be fired by a plurality of burners as heat sources.

With heating kilns as tunnel kilns, shuttle kilns and the like having a plurality of burners for heating products to be fired, in the past, the temperature in the kiln has been controlled by controlling outputs of the burners. In more detail, in order to control the temperature in the kiln, temperature detecting means for each of the burners is provided at one typical location whose temperature will be affected by heat flow from the burner. In this case, if the detected temperature with the detecting means is lower than a set temperature, the output of the burner is increased, while if the detected temperature is higher than the set temperature, the output of the burner is reduced until the detected temperature becomes equal to the set temperature. All the burners are controlled in this manner and it is assumed that the temperature in the kiln arrives at the set temperature.

In such temperature control of a kiln having a plurality of burners, the output of each burner being controlled on the basis of the temperature at only one typical point affected by heat flow from the burner, particularly in tunnel kilns and the like having a number of burners, the heat flow from one burner affects other temperature detecting means for controlling the outputs of the other burners, and thus the burners interfere with one another. Therefore, the outputs of the respective heat sources are unbalanced making it difficult to maintain the uniform temperature in the kiln at a set temperature. Accordingly, it is impossible to control the temperature in the kiln at an optimum temperature.

SUMMARY OF THE INVENTION

It is an object of the invention to provide an improved temperature control method for a heating kiln, which eliminates all the disadvantages of the prior art described above and is able to maintain the temperature in the kiln uniformly at a set temperature.

In order to accomplish this object, in the method for controlling temperature in a heating kiln having a plurality of heat sources for heating products to be fired according to the invention, output of each of said heat sources is controlled on the basis of temperatures at plural locations in said kiln to make the temperature in the kiln substantially equal to a set temperature of the kiln.

With the method according to the invention, outputs of burners are controlled taking account of not only the temperature at one location affected by heat flow from the target burner but also temperatures at plural locations affected by heat flow from the target burner. Therefore, the method according to the invention can control the temperature in a kiln in consideration of the influence of heat flow from the other burners, which will affect a typical location affected by the heat flow from the target burner. Accordingly, the temperature control can be effected grasping the actual temperature distribution in the kiln so that the temperature in the heating kiln can be maintained uniformly at a set temperature.

The invention will be more fully understood by referring to the following detailed specification and claims taken in connection with the appended drawings.

DESCRIPTION OF THE PREFERRED EMBODIMENTS

Figure 1:
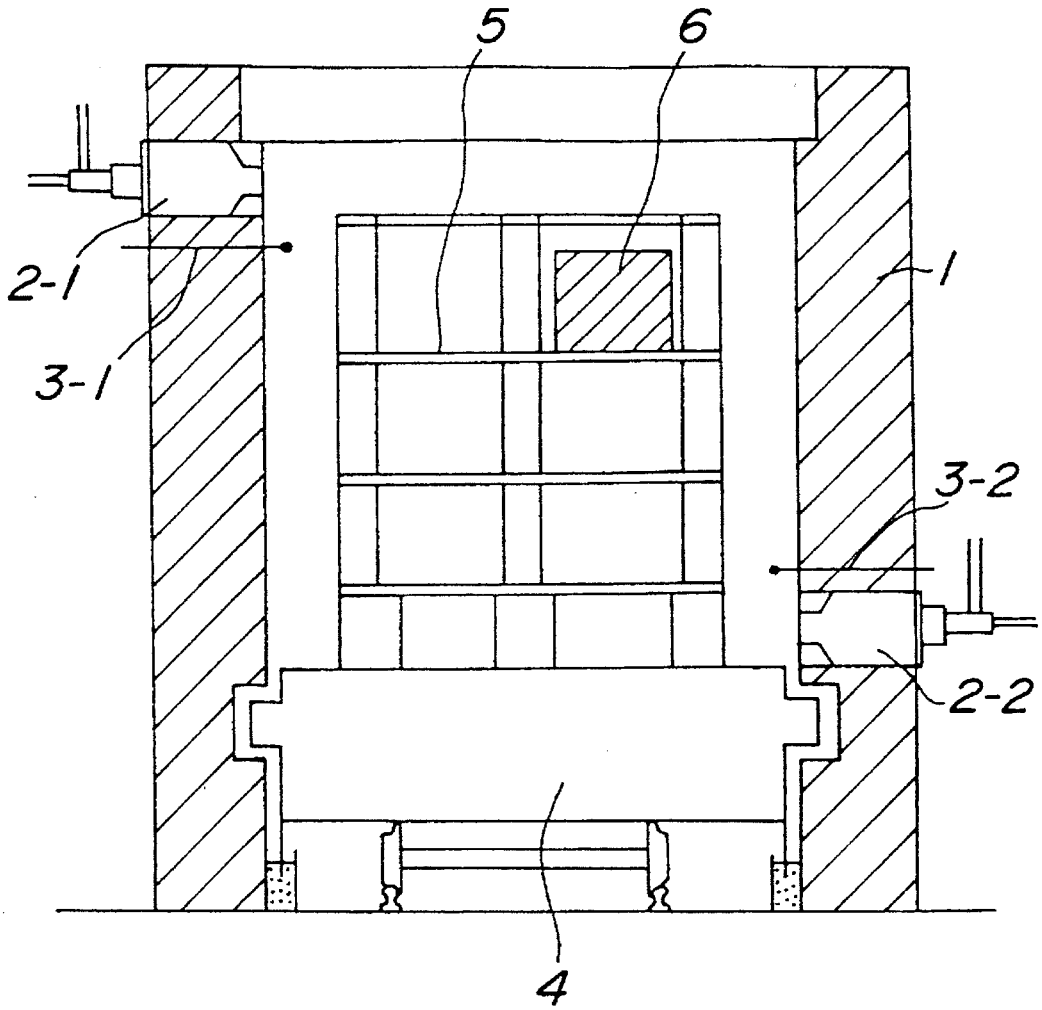
FIG. 1 is a sectional view illustrating one example of heating kilns for actually carrying out the heating kiln temperature control method according to the invention.

FIG. 1 illustrates in section a tunnel kiln as one example of the heating kilns for carrying out the heating kiln temperature control method according to the invention. The heating kiln has kiln walls 1 made of refractory material and comprises burners 2-1 provided at top portions of the kiln walls 1, burners 2-2 provided at the bottom portions of the walls 1 and thermocouples 3-1 and 3-2 as temperature detecting means provided for measuring the temperature in the proximity of the burners 2-1 and 2-2. Moreover, the kiln accommodates therein carriages 4, shelves 5 on the carriages, and products to be fired (e.g., honeycomb structures 6) arranged on the shelves 5.

In the illustrated embodiment, the temperature of the kiln is controlled simultaneously making use of temperatures in connection with the pair of burners 2-1 and 2-2 on the basis of the discovery that heat flow from the bottom burner 2-2 will affect the temperature measured by the top thermocouple 3-1 for the top burner 2-1, while heat flow from the top burner 2-1 will affect the temperature measured by the bottom thermocouple 3-2 for the bottom burner 2-2. In other words, in controlling the output of the burner 2-1, the temperature measured by the thermocouple 3-2 is utilized in addition to the temperature measured by the thermocouple 3-1, while in controlling the output of the burner 2-2, the temperature measured by the thermocouple 3-1 is utilized in addition to the temperature measured by the thermocouple 3-2.

In case when the controlling is effected with mean values of temperatures, as one example of practical control, first the mean value $Ta=(T1+T2)/2$ is calculated, where T1 and T2 are temperatures measured by the thermocouples 3-1 and 3-2, respectively. The mean temperature Ta is then compared with the set temperature T0 and if Ta is lower than T0, that is ($Ta<T0$), outputs of the burners 2-1 and 2-2 are increased by substantially equal extent. On the other hand, if Ta is higher than T0, that is ($Ta>T0$), outputs of the burners 3-1 and 3-2 are decreased by substantially equal extent. In this manner, the temperature of the kiln is controlled to bring the temperature Ta into coincidence with the set temperature T0.

In case when handicap control is effected as another example of the temperature control according to the invention, it is performed by supposing the actual operation of a kiln. Influence of the bottom burner 2-2 on the temperature measured by the thermocouple 3-1 for the top burner 2-1 is now referred to as "contribution rate α1" while influence of the top burner 2-1 on the temperature measured by the thermocouple 3-2 for the bottom burner 2-2 is referred to as "contribution rate α2". In case when temperature measured by the thermocouple 3-1 is not changed when the output of the bottom burner is changed, then the contribution rate α1=0. In case when temperature measured by the thermocouple 3-2 is not changed when the output of the top burner is changed, then the contribution rate α2=0. In those cases other than the above two cases, the respective contribution rates α1 and α2 are determined as follows:

In explaining the determination of the contribution rates α1 and α2, the tunnel kiln of FIG. 1, which was constructed to be divided into a plurality of zones so as to be insusceptible to burned flows from the burners flowing in the longitudinal direction of the kiln, is used.

Both the outputs of the burners 2-1, 2-2 are equally set to a determined value and the kiln is started for operation. When the temperatures of the thermocouples 3-1, 3-2 reach a steady state (state 1), temperatures t10, t20 indicated by the respective thermocouples 3-1, 3-2 are read.

Next, while maintaining the output of the burner 2-1, the output of the burner 2-2 is increased by 10%. Thereafter, when the temperatures of the thermocouple 3-1, 3-2 reach a steady state, temperature t11 indicated by the thermocouple 3-1 is read. Then, the output of the burner 2-2 is reduced so as to return the kiln to state 1.

Next, while maintaining the output of the burner 2-2, the output of the burner 2-1 is increased by 10%. Thereafter, when the temperatures of the thermocouples 3-1, 3-2 reach a steady state, temperature t21 indicated by the thermocouple 3-2 is read.

Then, the following simultaneous equations are solved to obtain α1 and α2.

$$\begin{cases} \alpha 1/(1-\alpha 1-\alpha 2)=(t11-t10)/10 \\ \alpha 2/(1-\alpha 1-\alpha 2)=(t21-t20)/10 \end{cases}$$

The contribution rates α1 and α2 are unitless.

When the heating kiln is operated, handicap temperatures TH1 and TH2 for the top and bottom burners are calculated according to the equations TH1=T1+(T2−T1)α1 and TH2=T2+(T1−T2)α2. In controlling the burner 2-1, if the handicap temperature TH1 is lower than the set temperature T0, that is (TH1<T0), the burner 2-1 is controlled to increase its output. If TH1>T0, the burner 2-1 is controlled to reduce its output. In this manner, the handicap temperature TH1 is brought into coincidence with the set temperature T0. The output of the bottom burner 2-2 is also controlled in the similar manner.

Actual examples of the embodiment of the invention will be explained hereinafter.

EXAMPLE 1

Figure 2:
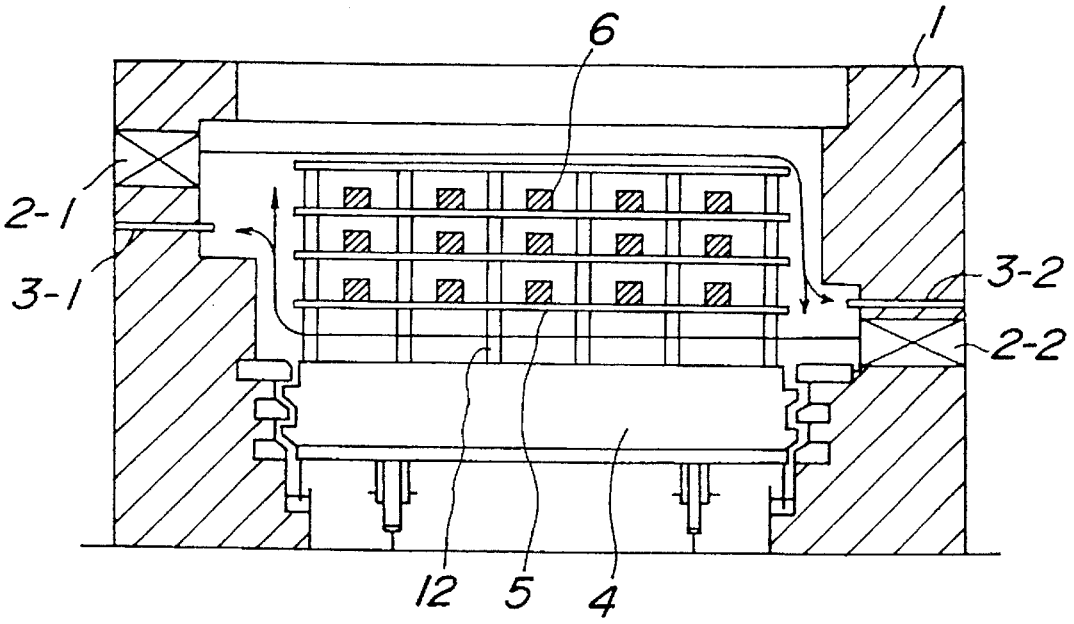
FIG. 2 is a sectional view illustrating one example of heating kilns used in one embodiment of the invention.

Honeycomb structures 6 made of cordierite were actually fired in a tunnel kiln of the under top firing system constructed as shown in FIG. 2. In the tunnel kiln shown in FIG. 2, burners 2-1 and 2-2 were provided at top portions and bottom portions opposite thereto, and thermocouples 3-1 for the top burners 2-1 were provided immediately below the top burners and thermocouples 3-2 for the bottom burners 2-2 were provided immediately above the bottom burners, respectively. Moreover, the tunnel kiln was constructed to be divided into a plurality of zones so as to be insusceptible to heat flow from the burners flowing in the longitudinal direction of the kiln. As a result, heat flow from the bottom burners 2-2 substantially affected the thermocouples 3-1 for the top burners, while heat flow from the top burners 2-1 substantially affected the thermocouples 3-2 for the bottom burners.

Automatic temperature control upon firing was carried out by automatic control of prior art, gas control valve opening limit control, mean value control and handicap control, respectively. Temperatures were measured by the thermocouples at certain instants, and defects and others occurred in the honeycomb structures after fired were judged. In controlling with the automatic control of prior art, the outputs of the burners were automatically controlled to make the measured temperatures to be equal to the set temperatures by referring to temperatures read from the thermocouple 3-1 for controlling the burner 2-1 and temperatures read from the thermocouple 3-2 for controlling the burner 2-2. In controlling with the gas control valve opening limit control, the control of gas flow was forcedly stopped at the top limit of 80% and the bottom limit of 30% of valve openings. Moreover, in controlling with mean value control and handicap control, the burners were controlled as in the examples described above. Results are shown in Table 1.

TABLE 1

| Control method | | Embodiment No. 1 Prior art automatic | 2 Valve opening limit | 3 Mean value | 4 handicap |
|---|---|---|---|---|---|
| Gas valve opening (%) | Top portion | 0 | 30 | 50 | 50 |
| | Bottom portion | 100 | 80 | 50 | 53 |
| Thermocouple temperature (set at 1380° C.) | Top portion | 1460 | 1399 | 1380 | 1380 |
| | Bottom portion | 1300 | 1364 | 1375 | 1380 |
| Temperature distribution in shelves (°C.) (MAX-MIN) | | 100 | 30 | 15 | 8 |
| Defect in appearance (%) | Melt | 30 | 15 | 0 | 0 |
| | Crack | 5 | 4 | 0 | 0 |
| | Discoloring | 15 | 10 | 0 | 0 |
| Defect in size | Shrinkage | 30 | 15 | 0 | 0 |

TABLE 1-continued

| Control method | Embodiment No. 1 Prior art automatic | 2 Valve opening limit | 3 Mean value | 4 handicap |
|---|---|---|---|---|
| Deformation | 5 | 3 | 0 | 0 |
| Irregularity in water absorption (%) (MAX-MIN) | 5.0 | 4.5 | 1.7 | 1.1 |
| Judgment | X | X | ○ | ⊙ |

EXAMPLE 2

Figure 3:
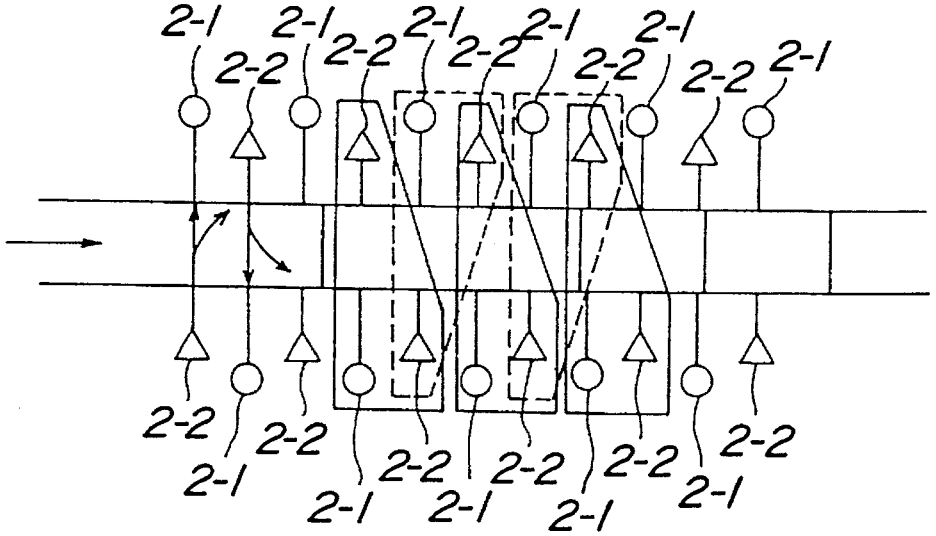
FIG. 3 is a sectional view illustrating another heating kiln used in another embodiment of the invention.

Honeycomb structures made of cordierite were fired in the same manner as in Example 1 in a tunnel kiln of the under top firing system constructed as shown in FIG. 3 and measurements were performed in the similar manner as in Example 1. In the tunnel kiln of the structure shown in FIG. 3, a burner 2-1 was provided at the top portion of the kiln and a burner 2-2 was provided at the bottom portion opposite thereto, and a thermocouple (not shown) for the top burner 2-1 was provided immediately below the top burner and a thermocouple (not shown) for the bottom burner 2-2 was provided immediately above the bottom burner, respectively, to form a first pair of burners having thermocouples. At one side wall of the kiln a second pair of the bottom burners 2-2 are arranged adjacent to a first pair of the top burners 2-1, and at the other side wall of the kiln a second pair of the top burners 2-1 are arranged adjacent to a first pair of the bottom burners 2-2. In this manner, pairs of burners were alternately arranged in the kiln as shown in FIG. 3.

The tunnel kiln was not divided into zones so that this kiln was susceptible to heat flow from the burners flowing in the longitudinal direction of the kiln. As a result, heat flow from the bottom burner substantially affected the thermocouple for the top burner in opposition thereto and the thermocouple for the adjacent downstream bottom burner as surrounded by solid lines in FIG. 3, and heat flow from the top burner substantially affected the thermocouple for the bottom burner in opposition thereto and the thermocouple for the adjacent downstream top burner as surrounded by broken lines in FIG. 3. In the mean value control and the handicap control, accordingly, the temperature control was effected taking account of the temperatures of the two relevant burners in addition to the temperature of the target burner. Results are shown in Table 2.

TABLE 2

| Control method | | Embodiment No. 11 Prior art automatic | 12 Valve opening limit | 13 Mean value | 14 handicap |
|---|---|---|---|---|---|
| Gas valve opening (%) | Top portion | 0 | 30 | 45 | 45 |
| | Bottom portion | 100 | 80 | 45 | 55 |
| Thermocouple temperature (set at 1455° C.) | Top portion | 1470 | 1465 | 1455 | 1455 |
| | Bottom portion | 1400 | 1440 | 1440 | 1455 |
| Temperature distribution in shelves (°C.) (MAX-MIN) | | 100 | 40 | 13 | 5 |
| Irregularity in water absorption (%) (MAX-MIN) | | 6.5 | 4.5 | 1.5 | 0.9 |
| Defect in appearance (%) | Melt | 80 | 50 | 0 | 0 |
| | Crack | 5 | 5 | 0 | 0 |
| | Discoloring | 5 | 2 | 0 | 0 |
| Defect in size | Shrinkage | 5 | 1 | 0 | 0 |
| | Deformation | 5 | 1 | 0 | 0 |
| Judgment | | X | X | ○ | ⊙ |

EXAMPLE 3

Figure 4:
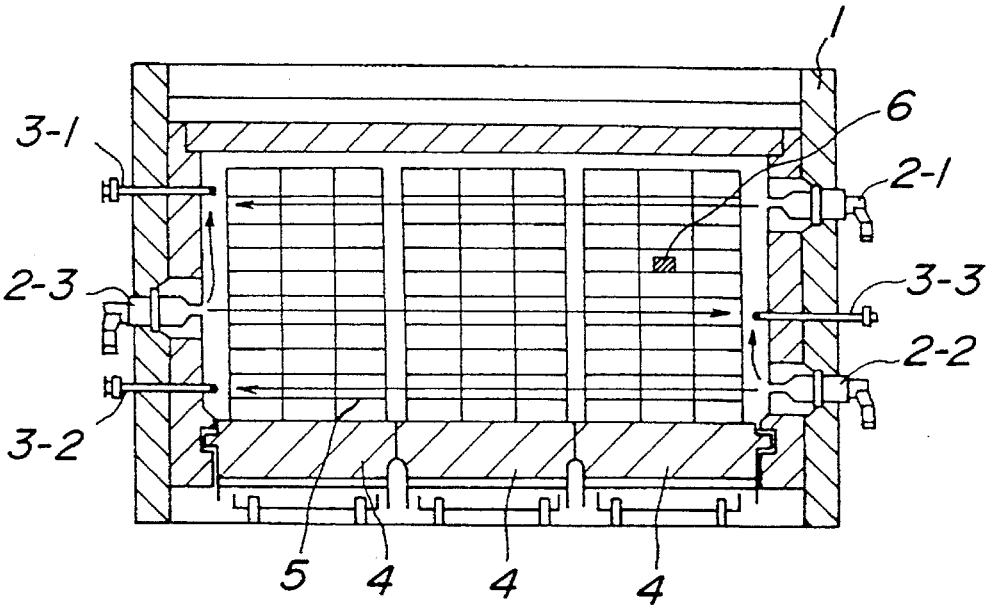
FIG. 4 is a sectional view illustrating a further heating kiln used in a further embodiment of the invention.

Honeycomb structures made of cordierite were fired in the same manner as in Example 1 in a shuttle kiln of the down draft system constructed as shown in FIG. 4 and measurements were performed in the similar manner as in Example 1. In the shuttle kiln of the structure shown in FIG. 4, there are provided a top burner 2-1, a bottom burner 2-2 and a middle burner 2-3 and thermocouples 3-1, 3-2 and 3-3 positioned in opposition to the top, bottom and middle burners for measuring temperatures of these burners, respectively. Therefore, heat flow from each of the burners 2-1, 2-2 and 2-3 affected its opposed thermocouple and the remaining two thermocouples. In the mean value control and handicap control, accordingly, the temperature control was effected taking account of the temperatures affected by all of the top, middle and bottom burners. Results are shown in Table 3.

TABLE 3

| Control method | | Embodiment No. 21 Prior art automatic | 22 Valve opening limit | 23 Mean value | 24 handicap |
|---|---|---|---|---|---|
| Gas valve opening (%) | Top portion | 100 | 65 | 75 | 80 |
| | Middle portion | 0 | 63 | 75 | 75 |
| | Lower portion | 75 | 75 | 75 | 75 |
| Thermocouple temperature (set at 1350° C.) | Top portion | 1330 | 1340 | 1345 | 1350 |
| | Middle portion | 1380 | 1348 | 1350 | 1350 |
| | Bottom portion | 1350 | 1350 | 1350 | 1350 |
| Temperature distribution in shelves (°C.) (MAX-MIN) | | 65 | 15 | 10 | 7 |
| Irregularity in water absorption (%) (MAX-MIN) | | 2.8 | 1.7 | 1.1 | 0.7 |
| Defect in appearance (%) | Melt | 30 | 5 | 0 | 0 |
| | Crack | 8 | 0 | 0 | 0 |
| | Discoloring | 10 | 2 | 0 | 0 |
| Defect in size | Shrinkage | 15 | 6 | 0 | 0 |
| | Deformation | 12 | 3 | 0 | 0 |
| Judgment | | X | X | ○ | ◎ |

EXAMPLE 4

Figure 5:
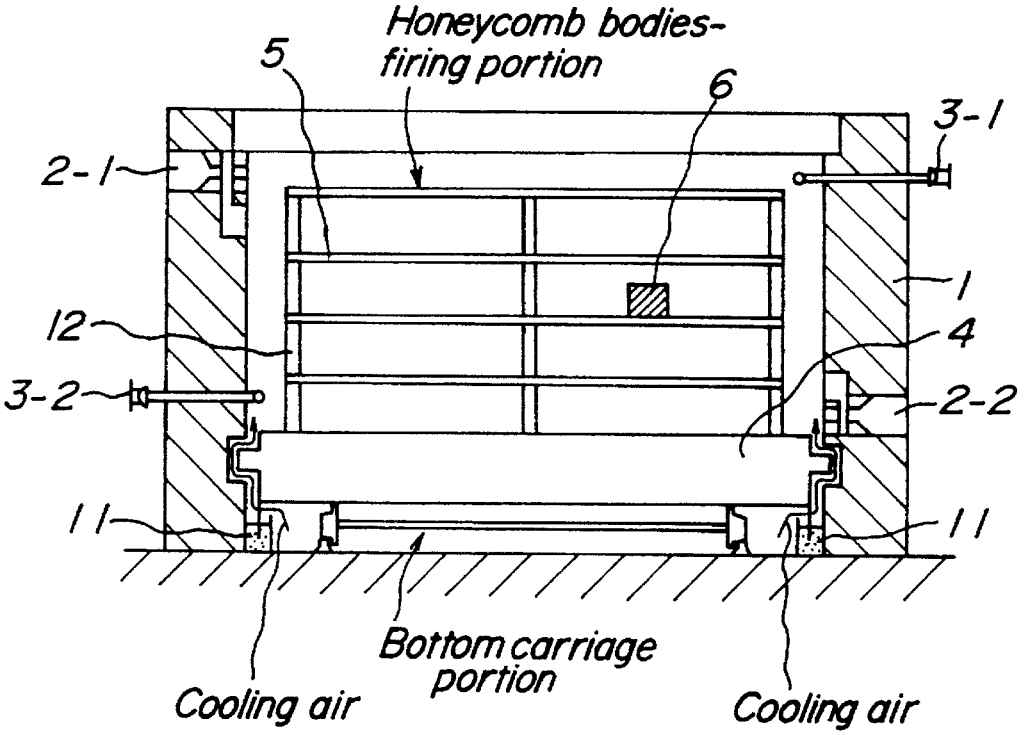
FIG. 5 is a sectional view illustrating another heating kiln used in another embodiment of the invention.

Honeycomb structures made of cordierite were fired in the same manner as in Example 1 in a tunnel kiln of the under top firing system constructed as shown in FIG. 5 and measurements were performed in the similar manner as in Example 1. The tunnel kiln shown in FIG. 5 was different from that of Example 1 shown in FIG. 2 in the feature of providing a thermocouple 3-1 arranged in opposition to and for a top burner 2-1 and a thermocouple 3-2 in opposition to and for a bottom burner 2-2. The tunnel kiln shown in FIG. 5 has a two stepped structure comprising a top portion in which honeycomb bodies are actually fired and a bottom carriages portion which supports the top portion, and is divided by sand seals 11. Both the top and bottom portions are respectively controlled of their inner pressures by independent fans (not shown). The wheel parts of the carriages portion are constructed from metal, so that the inner pressure of the bottom portion is set at a higher level than that of the top portion for preventing the wheel parts from oxidation by the firing atmosphere of a higher temperature of the top portion. By setting in this manner, cooling air is introduced from the bottom portion into the top portion. Embodiments of the Example 4 were performed supposing the conditions of problematic cases. The temperature control was effected under the condition that cooling air was blowing up due to incomplete engagement between carriages 4 and incompleteness of sand seals 11 in embodiments Nos. 31 to 34, and further under the condition when supporting columns 12 of shelves 5 on a carriage 4 faced to the bottom burner 2-2 in embodiments Nos. 35 to 38. Results are shown in Table 4.

TABLE 4

| Control method | | Embodiment No. 31 Prior art automatic | 32 Valve opening limit | 33 Mean value | 34 handicap | 35 Prior art automatic | 36 Valve opening limit | 37 Mean value | 38 handicap |
|---|---|---|---|---|---|---|---|---|---|
| Gas valve opening (%) | Top portion | 50 | 50 | 45 | 50 | 50 | 50 | 45 | 50 |
| | Bottom portion | 80 | 65 | 45 | 55 | 70 | 65 | 45 | 58 |
| Thermocouple temperature (set at 1410° C.) | Top portion | 1410 | 1410 | 1405 | 1410 | 1410 | 1410 | 1405 | 1410 |
| | Bottom portion | 1410 | 1405 | 1395 | 1400 | 1410 | 1406 | 1398 | 1403 |
| Temperature distribution in shelves (°C.) (MAX-MIN) | | 50 | 45 | 17 | 8 | 38 | 33 | 21 | 7 |
| Irrregularity in water absorption (%) (MAX-MIN) | | 5.0 | 4.7 | 1.5 | 0.9 | 4.3 | 2.8 | 1.7 | 1.0 |
| Defect in appearance (%) | Melt | 10 | 8 | 0 | 0 | 9 | 5 | 0 | 0 |
| | Discoloring | 2 | 0 | 0 | 0 | 3 | 1 | 0 | 0 |
| Defect in size | Shrinkage | 7 | 5 | 0 | 0 | 8 | 4 | 0 | 0 |
| | Deformation | 4 | 1 | 0 | 0 | 2 | 0 | 0 | 0 |
| Judgment | | X | X | ○ | ◎ | X | X | ○ | ◎ |

It has been found from the results of the Examples 1 to 4 that the temperature in a kiln can be maintained more uniformly at a set temperature by the mean value control and the handicap control according to the temperature control method of the present invention in comparison with the manual control method and the gas control valve opening limit control method of the prior art.

As can be seen from the above explanation, according to the invention the control of operating conditions of burners is performed taking account of not only the temperature near the target burner but also temperatures of other burners in the proximity of the target burner, whose heat flow will affect the temperature in the vicinity of the target burner. Therefore, the method according to the invention can control the temperature in a kiln in consideration of actual temperature distribution in the kiln so that the temperature in the heating kiln can be maintained uniformly at a set temperature.

While the invention has been particularly shown and described with reference to preferred embodiments thereof, it will be understood by those skilled in the art that the foregoing and other changes in form and details can be made therein without departing from the scope of the claims.

What is claimed is:

1. A method for obtaining and maintaining a substantially uniform temperature throughout a heating kiln, which uniform temperature is substantially equal to a set temperature, said kiln having a firing zone, a plurality of heat sources for heating products to be fired in said firing zone, and a plurality of heat detecting means being the same in number as said plurality of heat sources in said firing zone, said plurality of heat detecting means being respectively positioned at a plurality of locations, each said heat detecting means in said firing zone being affected by heat flows from said plurality of heat sources in said firing zone, said method comprising the steps of:

detecting temperatures by said plurality of heat detecting means;

calculating a mean temperature for said heat sources from the temperatures detected by said plurality of heat detecting means; and controlling outputs of each of said heat sources based on the temperatures detected by said plurality of heat detecting means to make said mean temperature substantially equal to the set temperature of the heating kiln.

2. The method of claim 1, wherein:

the steps of detecting temperatures comprises providing temperature detecting means in the proximity of each said target heat source to detect the temperature of each said target heat source;

the step of calculating a mean temperature uses the temperatures detected by said temperature detecting means; and the step of controlling outputs of said target heat sources comprises controlling the output of each target heat source to substantially the same extent.

3. The method of claim 2, wherein said temperature detecting means are provided on inner walls of the heating kiln opposite to each said target heat source.

4. A method for obtaining and maintaining a substantially uniform temperature throughout a heating kiln, which uniform temperature is substantially equal to a set temperature, said kiln having a firing zone, a plurality of heat sources for heating products to be fired in said firing zone, and a plurality of heat detecting means being the same in number as said plurality of heat sources in said firing zone, said plurality of heat detecting means being respectively positioned at a plurality of locations, each said heat detecting means in said firing zone being affected by heat flows from said plurality of heat sources in said firing zone, said method comprising:

detecting temperatures by said plurality of heat detecting means;

calculating a handicap temperature for each heat source based upon temperatures detected by said plurality of heat detecting means; and controlling outputs of said heat sources based upon the temperatures detected by said plurality of heat detecting means, to make said handicap temperatures substantially equal to the set temperature of the kiln.

5. The method of claim 2, further comprising the steps of determining contribution rates $\alpha 2$ and $\alpha 1$ of first and second heat sources, wherein $\alpha 2$ corresponds to the influence of the first heat source on the temperature T2 detected by heat detecting means used for the second heat source and $\alpha 1$ corresponds to the influence of the second heat source on the temperature T1 detected by heat detecting means used for the first heat source;

calculating handicap temperatures TH1 and TH2 for the first and second heat sources, respectively, using the following equations:

$$TH1=T1+(T2-T1)\ \alpha 1$$

$$TH2=T2+(T1-T2)\ \alpha 2;\ \text{and}$$

controlling outputs of said first and second heat sources to make the handicap temperatures TH1 and TH2 coincide with the set temperature.

* * * * *